US006584736B2

(12) United States Patent
Szymanski et al.

(10) Patent No.: US 6,584,736 B2
(45) Date of Patent: Jul. 1, 2003

(54) STAND-MOUNTABLE FOAM-TYPE ACOUSTIC PANEL

(75) Inventors: Jeffrey E. Szymanski, Indianapolis, IN (US); Eric T. Smith, Indianapolis, IN (US); David R. Harbison, Indianapolis, IN (US)

(73) Assignee: Auralex Acoustics, INC, Indianapolis, IN (US)

( * ) Notice: Subject to any disclaimer, the term of this patent is extended or adjusted under 35 U.S.C. 154(b) by 3 days.

(21) Appl. No.: 09/822,061

(22) Filed: Mar. 30, 2001

(65) Prior Publication Data

US 2002/0139066 A1 Oct. 3, 2002

(51) Int. Cl.[7] ..... E04B 1/82

(52) U.S. Cl. ..... 52/145; 52/5; 52/589.1; 52/590.2; 5/640; 181/288; 181/294

(58) Field of Search ..... 52/144, 145, 589.1, 52/590.1, 590.2, 592.1, 71; 5/470, 640, 657; 181/284, 288, 290, 294

(56) References Cited

U.S. PATENT DOCUMENTS

| | | | | |
|---|---|---|---|---|
| 4,437,542 A | | 3/1984 | Yeager et al. | |
| 4,702,046 A | | 10/1987 | Haugen et al. | |
| 4,703,597 A | * | 11/1987 | Eggemar | 52/220 |
| 4,796,397 A | | 1/1989 | Capaul | |
| 4,964,250 A | | 10/1990 | Nelson | |
| 5,009,043 A | | 4/1991 | Kurrasch | |
| 5,069,011 A | | 12/1991 | Jenne | |
| 5,111,579 A | | 5/1992 | Anderson | |
| 5,327,698 A | | 7/1994 | Uhl | |
| 5,572,847 A | | 11/1996 | Elmore et al. | |
| 5,618,602 A | * | 4/1997 | Nelson | 428/60 |
| 5,622,012 A | * | 4/1997 | Schijf | 52/71 |
| 5,641,950 A | | 6/1997 | Kotter | |
| 5,643,139 A | * | 7/1997 | Stout et al. | 482/14 |
| 5,651,405 A | | 7/1997 | Boeddeker et al. | |
| 5,896,710 A | | 4/1999 | Hoyle | |
| 5,940,913 A | * | 8/1999 | Horowitz | 5/640 |
| 6,007,890 A | | 12/1999 | DeBlander | |
| 6,085,861 A | | 7/2000 | Jines | |
| 6,244,378 B1 | | 6/2001 | McGrath | |

FOREIGN PATENT DOCUMENTS

DE 4002547 * 8/1991

OTHER PUBLICATIONS

Auralex Acoustics 2001—Complete Product Guide, pp. 10–11; p. 15; pp. 18–20.

* cited by examiner

*Primary Examiner*—Carl D. Friedman
*Assistant Examiner*—Yvonne M. Horton
(74) *Attorney, Agent, or Firm*—E. Victor Indiano; Indiano, Vaughan & Roberts, P.A.

(57) ABSTRACT

A foam-type acoustic panel is designed to be mountable on a stand having a shaft. The acoustic panel includes a main body portion. The main body portion has a first end, a second end, a front surface, a rear surface, a top surface, a bottom surface, and first and second interlocking members. The first and second interlocking members define a multi-segment cut that extends between the top and bottom surface. The multi-segment cut includes a first end disposed at one of the front and rear surfaces, and a second end disposed interiorly of the other of the front and rear surfaces. The second end of the multi-segment cut defines an elongated aperture extending between the top and bottom surface for receiving a shaft of a stand.

21 Claims, 3 Drawing Sheets

STAND-MOUNTABLE FOAM-TYPE ACOUSTIC PANEL

TECHNICAL FIELD OF THE INVENTION

The present invention relates to acoustic panels, and more particularly to foam-type acoustic panels.

BACKGROUND OF THE INVENTION

It has long been known that acoustic panels can be employed to change the acoustic qualities of a space, such as a room, studio, theater or stadium. A wide variety of acoustic-affecting materials, such as acoustic ceiling tiles and carpet are employed even in interior or exterior spaces (e.g. room, pool area) of houses, offices and commercial spaces where the acoustic characteristics of the space are not that critical. However, certain situations exist where the acoustic characteristics of a space are sufficiently critical so as to require more extraordinary treatment and devices to achieve the desired acoustic quality. Such environments include places such as music practice rooms, concert venues, recording studios and broadcast facilities.

To achieve the desired acoustical characteristics of an acoustic quality critical space, musicians and those who own the sound-critical spaces have long employed a variety of acoustic devices, such as acoustic foam panels to enhance the acoustic qualities of the space. Examples of such acoustic foam panels can be found at the Applicant's web site at www.auralex.com. A review of Applicant's web site discloses that these acoustic foam panels come in a wide variety of shapes and sizes. Although many of the foam panels are designed for general purpose use, some of the foam panels are designed for more special applications, or to perform more specific functions. Different types of panels that exist include things such as base trap panels that are designed especially for absorbing low-range, base sounds; corner panels that are designed to fit easily into corners of rooms; broad-band absorbers that are designed to absorb sound over a wide range of frequencies; and wedge-type absorbers that are especially useful for spot treating certain areas in spaces.

It should also be noted that acoustic foam panels employ a wide variety of facial configurations, with some facial configurations being adapted to perform certain functions, while other facial configurations are designed with primarily esthetic considerations in mind. Other sound panels are designed to not only absorb sound, but also to defuse sound over a given area. Further, some sound-absorbing panels are used primarily as sound and vibration insulators that are placed between a pair of hard surfaces, such as a platform and a floor to acoustically isolate two hard members from each other, to thereby reduce the likelihood that vibrations of one hard member will cause vibrations in the second hard member. Further, hard and/or dense, non-foam type acoustic panels exist that are used primarily to provide sound barriers between adjacent spaces.

One factor that has influenced the design and usability of sound panels is the electronic revolution. In times as recent as the 1970s and 1980s, a musician or other sound recording person who desired to obtain a studio-quality recording was often forced to make his recording in a specially-designed studio. This requirement existed not so much because of the acoustic properties of the room, but rather resulted from the significant expense required to obtain studio-quality electronic recording equipment, such as multi-track tape recorders, mixers and the like. Recently, sound recording technology has changed from the prior-used analog equipment to digital recording equipment. Concurrently, low cost personal computers have become sufficiently powerful so as to be able to process large amounts of digital data. These two technological developments have resulted in studio-class, high quality recording equipment being obtainable at a price that is affordable by persons such as musicians, radio personalities, voice talents and recording engineers. As such, the relatively low cost and small size of current state-of-the-art recording equipment has permitted many musicians, voice talents and other persons to set up "home studios" in their homes, apartments or office spaces, that have electronic recording equipment that is capable of making high-quality "studio grade" recordings.

Even though the declining price of studio-quality recording equipment has permitted the creation of such "home studios," room acoustical quality issues still must be addressed by the home studio owner. Prior to the instant invention, the problem of acoustic quality was handled in a manner similar to the manner in which it was handled in professional studios. That is, the home studio owner would purchase acoustic panels, such as the foam panels shown at www.auralex.com, and install these panels within the home studio to achieve the desired acoustical characteristics of the space.

Although the installation of traditional foam panels within a room of the user's home, has the capability of providing the user with an acoustically, highly-functional studio, room for improvement still exists. One area in which room for improvement exists relates to the utilization of the living areas and space within the user's home. As will be appreciated, a room that is outfitted as a studio, and that contains walls having foam panels thereon, may be aesthetically undesirable to use for purposes other than a studio.

Although the installation of panels in a room to cause the room to be dedicated for use as a studio may be quite acceptable to those having dwellings with multiple or extra rooms, it may cause a less than desirable situation for a user having limited rooms or space within his dwelling. For example, room size considerations may dictate that the living room is the most suitable room within the user's dwelling for use as a studio. However, the user may not wish to panel his living room in acoustic foam, since this may leave the living room aesthetically unsuitable for use as a living room to entertain guests. Therefore, it will be appreciated that situations such as those described above would be improved if the acoustic panels were designed to be easily installable and removable, so that the panels could be installed when the living room was being used as a studio, but uninstalled and stored out-of-sight when the user desired to use the room as a normal living room.

One object of the present invention is therefore to provide an acoustic panel that lends itself to temporary installation in a room, while providing easy de-installation.

SUMMARY OF THE INVENTION

In accordance with the present invention, a foam-type acoustic panel is designed to be mountable on a stand having a shaft. The acoustic panel includes a main body portion. The main body portion has a first end, a second end, a front surface, a rear surface, a top surface, a bottom surface, and first and second interlocking members. The first and second interlocking members define a multi-segment cut that extends between the top and bottom surface. The multi-segment cut includes a first end disposed at one of the front and rear surfaces, and a second end disposed interiorly of the other of the front and rear surfaces. The second end of the multi-segment cut defines an elongated aperture extending between the top and bottom surface for receiving the shaft of the stand.

Preferably, first and second interlocking members are movable between a disengaged position and an engaged position. In the disengaged position, a shaft of a stand can be received into the elongated aperture by passing the shaft laterally through the multi-segment cut. In the engaged position, the shaft is engaged by the acoustic panel with sufficient frictional force to maintain the acoustic panel at a chosen vertical position on the shaft.

Additionally, in the preferred embodiment of the present invention, the first interlocking member includes a first portion extending in a first direction generally non-perpendicular to a plane defined by one of the front and rear surfaces. The first interlocking member also includes a second portion extending in a direction generally perpendicular to the first direction, and a third portion extending in a third direction defining an acute angle to the second direction. The second interlocking member includes a first portion for receiving the first portion of the first interlocking member, and a second portion for receiving the second portion of the first interlocking member. Further, the second interlocking member also includes a third, partly-cylindrical portion for receiving a bulbous male portion of the third portion of the first interlocking member.

One feature of the present invention is that the acoustic panel of the present invention can include a first end interlocking member that is disposed at the first end of the main body portion of the acoustic panel member; and a second interlocking member that is disposed at the second end of the main body portion. Through this arrangement, the acoustic panel of the present invention can comprise a first acoustic panel that is capable of being joined to a second acoustic panel by matingly engaging the first end interlocking member of the first acoustic panel with the second interlocking member of the second acoustic panel, to place the first and second acoustic panels in a co-planar end-to-end interlocked relation. Through this feature, the user can create a gapless, multi-segment panel having a length that may be two or more multiples of the length of any particular acoustic panel. Through this, the user gains enhanced flexibility in setting up acoustic panels, so that the acoustic panels of the present invention can be easily transferred from room to room by adding or removing acoustic panels as necessary to create an array of acoustical panels that is suitable for the particular sized room in which the acoustic panels are being used.

Another feature of the present invention is that the multi-segment cut includes a first end disposed at one of the front and rear surfaces, and a second end disposed interiorly of the other of the front and rear surfaces. Through this arrangement, the multi-segment cut can receive the shaft of the stand, without the cut extending completely through the panel. This arrangement helps to make the panel more structurally strong, and secure; and easier to assemble, as the shaft is preferably engaged by the acoustic panel near the middle (when measured from side to side) of the panel. As the shaft engages the acoustic panel near its middle, the weight of the panel is balanced relative to the shaft, thus making the stand and panel combination more securely positionable.

These and other features of the present invention will be apparent to those skilled in the art upon review of the best mode of practicing the present invention described below in connection with the following drawings.

DETAILED DESCRIPTION OF PREFERRED EMBODIMENT

Figure 1:
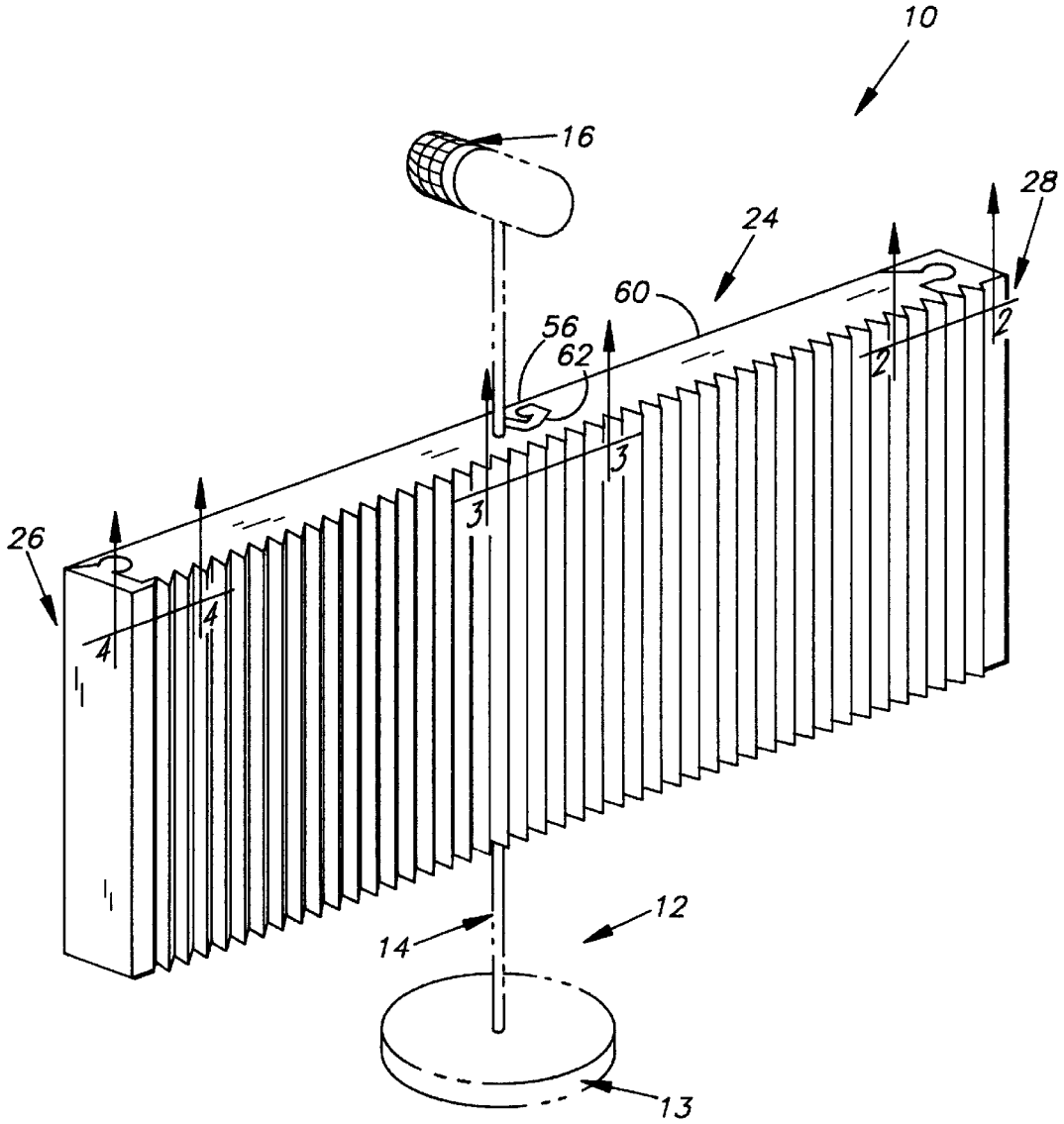
FIG. 1 is a perspective view of the acoustic panel of the present invention.
Figure 5:
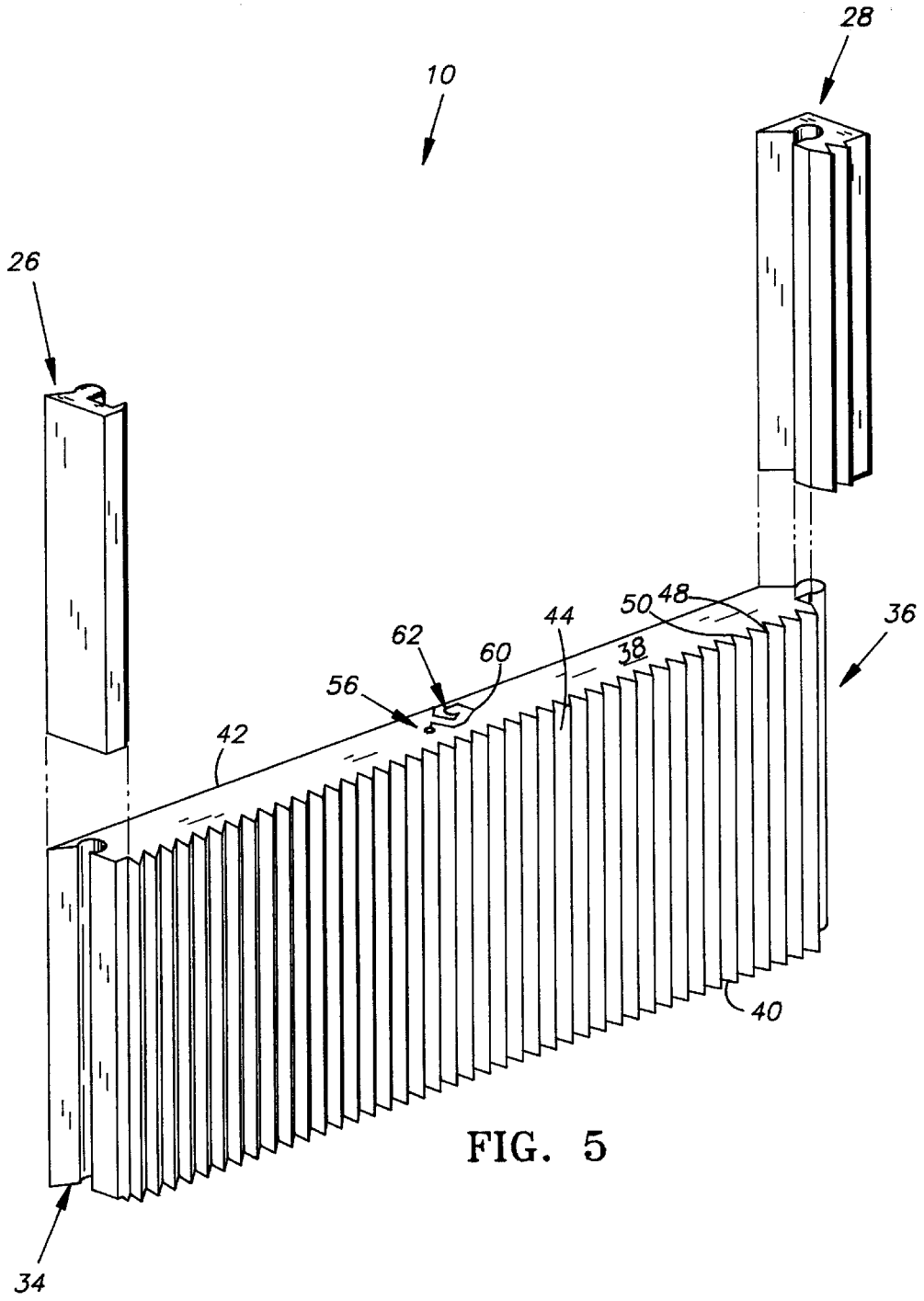
FIG. 5 is an exploded, perspective view of the present invention.

Acoustic panel 10 of the present invention is best shown in FIGS. 1 and 5 as being mountable to a stand 12, such as a microphone stand. The stand 12 includes a base for supporting the stand 12 on the ground or other surface, and a vertically extending, generally cylindrical shaft. Although most microphone shafts are cylindrical and telescoping, it will be appreciated that the shaft can be configured in any one of a variety of cross-sectional shapes. Although a microphone 16 is shown as being mounted to the top of the stand 12, the microphone 16 is largely superfluous of the present invention, and is provided in the drawings for illustrative purposes only.

The acoustic panel 10 includes a main body portion 24, a first end portion 26, and a second end portion 28. The main body 24 is generally unitarily constructed so that it comprises one piece. However, the first and second end portions 26, 28 are detachably coupled to the respective first and second ends of the main body portion 24. Main body portion 24, along with the first and second end portions 26, 28 are preferably made from the same sound absorbing foam material. Although a variety of foams can be used, a preferred foam is the Assignee's STUDIO FOAM™ foam material, panels of which are available at www.auralex.com. Other sound-absorbing acoustic foam materials also exist that will also serve as suitable materials from which the acoustic panel of the present invention can be made, although such other foams will likely not perform quite as well as the Assignee's proprietary STUDIO FOAM™ product. When constructing the panel, the foam should be chosen based on a balancing of factors such as sound-absorption characteristics, cost, and working characteristics.

The main body portion 24 includes a first end 34, and a second end 36. In the embodiment shown in FIGS. 1 and 5, the first and second end 34, 36 comprise the side ends of the panel's main body portion 24. However, it will be appreciated that the particular orientation of the main body panel 10 is somewhat arbitrary. Therefore, even though first end 34 is shown as the left side, the main body portion 24 could be rotated 90° so that the first end 34 is the top of the main body portion 24; rotated 180° so that the first end 34 is disposed on the right side of the main body portion 24; or rotated 270° so that the first end 34 serves as the bottom of the panel's main body portion 24. As will described in detail below, the first end 34 and second end 36 are configured to be jig-saw-puzzle-piece shaped (in a cross-section) so that the first end 34 and second end 36 can be interlocked with end panel members, such as first end panel member 26 and second end panel member 28, respectively; or with an adjacent, co-planerly-disposed second foam acoustic panel (not shown).

Additionally, the main body portion 24 includes a generally planar top surface 38, a generally planar bottom surface 40, and a generally planar rear surface 42. However, the front surface (or facia) 44 is not planar. Rather the front surface 44 comprises a series of parallel wedges, with each wedge being generally triangular in cross-section, and including a raised edge portion 48 and a relatively depressed valley portion 50. The wedge-shaped surface of front facia 34 is the surface that is designed to "face" the sound-generating apparatus, such as the musical instrument within the room in which the acoustic panel 10 is being used. The wedge shape of facia 44 is designed to enhance the sound absorbing quality of the acoustic panel 10, both by providing a means for capturing reflected sound waves, and also for increasing the sound absorbing surface area of the acoustic panel 10. Both of these characteristics help to enhance the sound absorbing qualities of the acoustic panel 10. Although the facia 44 is shown as having a wedge-shaped facia, other facia designs are also useable. For example, other facia shapes include shapes such as pyramids, irregular wedges, egg crate-like shapes or the like. Examples of various facia configurations can be viewed on the Applicant's web site, or by viewing sound foam products sold by the Assignee's competitors.

Although the main body portion 24 is a unitary member, the unitary main body portion 24 includes a multi-segment cut 62 that extends partially through the main body portion 24, from the back surface 40, to a point within the interior of the main body portion 24. The multi-segment cut 62 creates a first 56 and a second 60 interlocking member, that permit the main body portion 24 to be moved between: (1) an engaged position, as shown in FIG. 1, wherein the main body portion 24 is generally co-planar; and (2) a disengaged position (not shown) wherein the interlocking members 56, 60 are disengaged. When in the disengaged position, the shaft 14 of the microphone can be moved laterally from the first end of the multi-segment cut 62 to the vertically extending cylindrically-shaped aperture 64 that defines the second end of the multi-segment cut 62, thus permitting the shaft to be inserted within the vertically extending aperture 64.

When the interlocking members 56, 60 are in their disengaged position, the acoustic panel 24 main body portion (and any other elements attached thereto) can be moved vertically along the shaft 14, to vertically position the acoustic panel 10 on the shaft 14. When the first and second interlocking member 56, 60 are in their engaged position, the aperture 64 cooperates with the strength of the interlock created by the interlocking member 56, 60 to impart sufficient frictional engagement between the foam surface that defines the cylindrical wall 66 of the stand-receiving aperture 64, and the axially extending, radially outwardly facing surface of the stand 14, to maintain the acoustic panel 10 at its appropriate vertical position on the stand 14. The frictional engagement between the stand 14 and the cylindrical wall 66 is sufficiently great so that the desired vertical position of the acoustic panel 10 can be maintained even if, as shown in FIG. 1, no support underlines the planar bottom surface 40 of the main body portion 24 of the panel 10.

Figure 3:
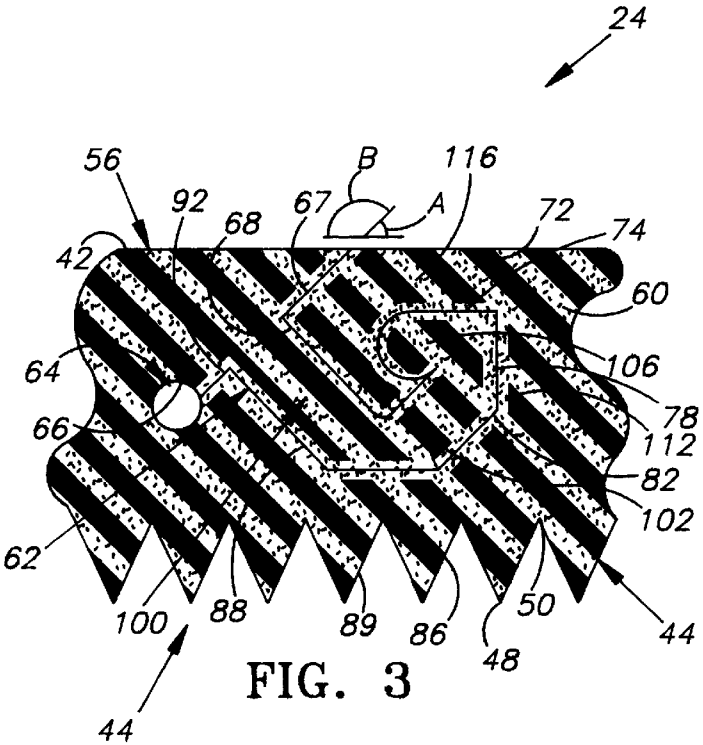
FIG. 3 is a sectional view taken along lines 33 of FIG. 1.

The multi-segment cut 62 includes a plurality of segments that define the first and second interlocking members 56, 60. As best shown in FIG. 3, the first segment 67 has its first end at the rear surface 42 of the acoustic panel main body portion 24. The first segment 67 extends at an angle that is not perpendicular to the plane of the rear surface 42. More particularly, the first segment 67 intersects the plane of the rear surface 42 on an acute angle (angle A) or obtuse angle (angle B) depending upon how the angle is viewed. In any event, segment 67 is not perpendicular to the rear planar surface 42.

The second end of the first segment 67 has a second end that terminates at the first end of second segment 68. Second segment 68 extends generally perpendicularly to first segment 67, and has a second end that terminates at the first end of third segment 72. Third segment 72 extends in a generally spaced, parallel relation to first segment 67, and is generally shorter than first segment 67. The second end of the third segment 72 terminates at the first end of fourth segment 74. Fourth segment 74 includes a partially circular (in cross-section) section that segues into a straight section that extends generally parallel to the rear planar surface 42.

The second end of fourth segment 74 terminates at a first end of fifth segment 78. Fifth segment 78 extends generally perpendicularly to the plane of the rear surface 42, and terminates at the first end of sixth segment 82. Sixth segment 82 extends in a direction generally parallel to third segment 72 and first segment 67. The sixth segment 82 terminates at the first end of seventh segment 86. Seventh segment 86 extends generally parallel to the plane of the rear surface 42 of the main body portion 24, and also generally parallel to the straight portion of the fourth segment 74.

The second end of seventh segment 86 terminates at a first end of the eighth segment 88. Eighth segment 88 extends generally parallel to second segment 68, and generally perpendicular to first segment 67. The eight segment 88 terminates at the first end of ninth segment 92. Ninth segment 92 extends generally parallel, and co-linear with the first segment 67, and also generally parallel to the third segment 72 and sixth segment 82. The second end of ninth segment 92, which also comprises the end of the multi-segment cut 62, terminates at the generally circular (in cross-section) and generally cylindrical (in shape) stand-engaging aperture 64.

The various segments 67, 68, 72, 74, 78, 82, 86, 88, and 92 define the first and second interlocking members 56, 60. First interlocking member 56 includes a first portion 100 that is defined generally by second segment 68, eighth segment 88, and part of seventh segment 86. The first portion of interlocking member 56 extends generally at an angle perpendicular to angle A, and generally obtuse (when compared to angle A) to the plane of the rear surface 42 of the main body portion 24. The second portion 112 is defined generally by third segment 72, sixth segment 82, a portion of seventh segment 86 and fifth segment 78. The second portion extends generally perpendicular to the major direction of extent of the first portion 110, and also extends in a direction generally parallel to the first and ninth segments 67, 92. The third portion 106 extends in a direction generally parallel to the plane 42 of the rear surface, and includes a bulbous male portion that is defined by the partly cylindrical portion of fourth segment 74. Additionally, the third portion is partly defined by fifth segment 78. As will be explained in more detail below, the bulbous, male, partly circular (cylindrical) head of third portion 106 is designed interlock into the second interlocking member 60.

The second interlocking member includes a first portion 110 that is generally female in configuration for receiving the first portion 100 of the first interlocking member. Second portion 112 of the second interlocking member is that portion of the second interlocking member 60 that is designed for receiving the second portion of the first interlocking member 56; and the third portion 116 of the second interlocking member is that portion of the second interlocking member 60 that is designed for receiving the third portion 106 of the first interlocking member 56, including the bulbous male portion thereof.

As stated above, the first 56 and second 60 interlocking members are movable between an engaged position, as shown in FIG. 3, and a disengaged position (not shown). In the disengaged position, the first and second interlocking members are not matingly engaged, so that the multi-segment cut 62 becomes a multi-segment slot. Because of the flexibility of the foam material from which the acoustic panel is made, the first and second interlocking members 56, 60 can be pivotably moved with respect to each other, generally about a pivot point defined by aperture 64, so that the first and second interlocking members 56, 60 are disengaged. When so disengaged, the shaft portion 14 of the stand 12 can be passed through the multi-segment cut 62, so that it can be moved from a position rearwardly of the rear surface 42, inwardly relates to the panel 10, until the shaft 14 is disposed within the shaft receiving aperture 64. As will also be appreciated, when the first and second interlocking members 56, 60 are disengaged, the first 100, second 102, and third 106 portions of the first interlocking member 56 are released from their adjacent positioning with the respect to first 110, second 112, and third 116 portions of the second interlocking member, so that the path followed by the shaft to the aperture 64 will generally follow a path defined by first cut segment 67, and ninth cut segment 92, as no part of the first portion 100 would extend between the first and ninth segments 67, 92 within the first and second 56, 60 interlocking members are fully disengaged.

After the shaft 64 is inserted into aperture 64, the first and second interlocking members 56, 60 are pivotably moved toward each other about pivot axis defined by shaft receiving aperture 64, until such time as the first and second interlocking members 56, 60 are fully engaged again, as shown in FIG. 3.

Due to the configuration of the first and second interlocking members, it is highly unlikely that the first and second interlocking members 56, 60 will become disengaged except in the event of specifically directed force applied to the first and second interlocking members 56, 60, to disengage them. Thus, under normal circumstances, the configuration of the first and second interlocking members 56, 60, will maintain the first and second interlocking members in an engaged position. Further, the configuration of the first and second interlocking members 56, 60 discourages lateral relative movement of the first and second interlocking members 56, 60, thus enabling the main body portion 24, and in particular, the foam 66 defining the cylindrical wall of shaft receiving aperture 64 to securely grip the shaft 64.

This grip is sufficiently secure so that the grip provided by the sizing of the aperture 64, the engagement of the first and second interlocking members 56, 60, and the normal co-efficient of friction of the foam material that comprises the cylindrical walls 66 cooperate to securely hold the main body portion 24 of the acoustic panel in its desired vertical position. As shown in FIG. 1, the vertical position of the acoustic panel can be maintained in its desired vertical position, even when the bottom surface 40 of the acoustic panel is unsupported, and hence "hanging in mid air".

Figure 4:
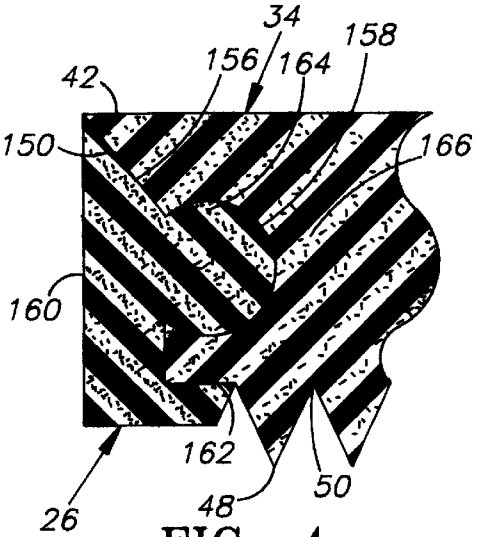
FIG. 4 is a sectional view taken along lines 4—4 of FIG. 1.

Turning now to FIG. 4, a cross-sectional view of first end 34 and first end panel 26 are shown, to illustrate the mating relationship between the two pieces. As discussed above, first end panel 26 is detachably matable to the first end 34, so that the first end panel 26 can be selectively removed, or attached as necessary. Although the acoustic panel 10 benefits by the inclusion of the first end panel 26, especially if acoustic panel 10 is being placed in a corner, the end panel 26 is not necessary in all situations. One such situation is when two or more acoustic panels are joined together to form an end-to-end co-planar array of panels.

The configuration of the mating surfaces of the first end panel 26 and first end 34 are best described with respect to the series of line segments (in cross-section) or planes (in 3-D) that form the mating intersecting surfaces of the first end panel 26 and first end 34. As will be noted from the drawing shown in FIG. 4, mating surfaces 26 of the first end panel fit flushly against the corresponding mating surfaces of the first end 34, so that full surface-to-surface engagement exists along the "end panel cut line" (plane) 150 therebetween. The intersection of the surfaces can properly be referred to as an end panel cut line, since the normal method of manufacturing the panel 10 is to create the end panel 26 by starting with a rectangularly-cuboid foam piece having a squared-offend and employing a saw blade to make the cut 150 to separate the first end 34 and first end panel 26 into separate and separable pieces.

The first end panel cut line 150 includes a first angled segment 156 that extends perpendicular to first segment 67 of main body portion cut line 62. Additionally, first angle segment 156 is generally not perpendicular to the plane of rear surface 42. The first angled segment 156 terminates at its second end at a partly circular (partly cylindrical) bulbous segment 158. The bulbous segment 158 includes a diameter at its widest extent that is generally wider than the distance measured between intersection point between the first angled segment 156 and bulbous segment 158; and the intersection of the first bulbous segment 158 and the first end of the third segment 160. This difference in diameters permits the bulbous nose 164 of the first portion of the first end panel 156 to lockingly engage the female receiving cavity 66 of the first end 34; and thereby lockingly engaging the first end panel 26 to the first end 34. The third segment 160 extends in a direction generally perpendicular to the plane of the rear surface 42, and terminates at its second end in a first segment 162, that extends generally parallel to the plane of the rear facing surface 42. As will be noted, the configuration of the end panel cut line 150 causes the first end panel 156 to have a jig-saw-puzzle-like engaging configuration for lockingly, but removably engaging the first panel 26 to the first end portion 34.

Figure 2:
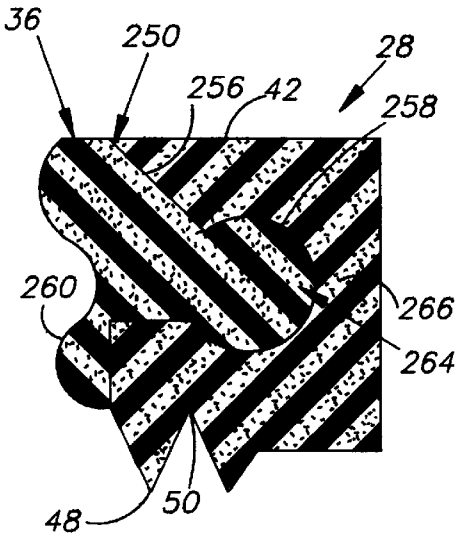
FIG. 2 is a sectional view taken along lines 22 of FIG. 1.

The mating configuration between the second end panel 28 and second end 36 of the main body portion is shown in FIG. 2. It will be noted that second end panel cut line 250 has a generally identical shape to the first end panel cut line 150. As such, the second end panel cut line 250 includes a first angled segment 256 that is disposed at an angle to the plane of the rear surface 42 that is generally identical to the angle at which the first angled segment 156 is disposed relative thereto.

A second bulbous segment 258 is generally an identical shape, diameter and radius of curvature to the first bulbous segment 158 of the first end panel 26. Finally, the third segment 260 is generally similar in orientation, direction of extent, and length to the third segment 160 of the first end cut line 150.

Through this identical "cut line" configuration, the second end panel 36 is generally identically shaped in cross-section to the first end panel 26, including the provision of a bulbous nose 264 that is sized to be received by a female receiver 266, that is generally identical in size and configuration to the female receiver 166 of the first end 34 of the main body portion 24.

This identicality of configuration permits the first acoustic panel to be coupled to a second acoustic panel in an end-to-end, co-planar relationship. One way for accomplishing this coupling is by joining the first end (not shown) of the second acoustic panel (not shown) to the second end 36 of the main body portion 24 of a first acoustic panel 10, so that the bulbous nose 274 of the second end 36 of the first acoustic panel 10 is lockingly engaged with the female receiver (not shown) of the second acoustic panel. Additionally (or alternately), the second end (not shown) of a second acoustic panel can be lockingly engaged to the first end 34 of a main body portion 24 of the first acoustic panel 10, through the insertion of the bulbous nose (not shown) of the second end of the second acoustic panel (not shown) being inserted into the female receiver 166 of the first end 34 of the main body portion 24. Of course, to so mate acoustic panels, the respective first and second end panels 26, 28 must be removed, to expose respective mating surfaces of the first 34 and second 36 ends of the main body portions.

Although the invention has been described in detail with reference to the illustrated preferred embodiments, variations and modifications exist within the scope and spirit of the invention as described and as defined in the following claims.

What is claimed:

1. A foam-type acoustic panel mountable to a stand having a shaft, the acoustic panel comprising:

a main body portion having (a) a first end, a second end, a front surface, a rear surface, a top surface and a bottom surface, the first end, second end, front surface, rear surface, top surface and bottom surface all comprised of a sound absorbing foam material, (b) a first interlocking member and a second interlocking member, the first and second interlocking members defining a multi-segment cut extending between the top and bottom surface, the multi-segment cut including a first end disposed at one of the front and rear surfaces, and a second end disposed interiorly of the other of the front and rear surfaces, the second end of the multi-segment cut defining an elongated aperture extending between the top and bottom surface for receiving a shaft of a stand.

2. The acoustic panel of claim 1 wherein the first interlocking member includes a first portion extending in a first direction generally non-perpendicular to the plane defined by one of the front and rear surfaces, a second portion extending in a direction generally perpendicular to the first direction, and a third portion extending in a third direction defining an acute angle to the second direction, wherein the first and second interlocking members are comprised of a unitary foam member.

3. The acoustic panel of claim 2 wherein the third portion includes a bulbous male portion.

4. The acoustic panel of claim 3 where the second interlocking member includes a first portion for receiving the first portion of the first interlocking member, a second portion for receiving the second portion of the first interlocking member, and a third partly-cylindrical portion for receiving the bulbous male portion of the third portion of the first interlocking member.

5. A foam-type acoustic panel mountable to a stand having a shaft, the acoustic panel comprising:

a main body portion having (a) a first end, a second end, a front surface, a rear surface, a top surface and a bottom surface (b) a first interlocking member and a second interlocking member, the first and second interlocking members defining a multi-segment cut extending between the top and bottom surface, the multi-segment cut including a first end disposed at one of the front and rear surfaces, and a second end disposed interiorly of the other of the front and rear surfaces, the second end of the cut defining an elongated aperture extending between the top and bottom surface for receiving a shaft of a stand, wherein the elongated aperture includes a shaft receiving opening extending between the top and bottom surface, and wherein the first and second interlocking members are placeable in a disengaged position for receiving a shaft of a stand into the elongated aperture by passing the shaft laterally through shaft-receiving opening of the multi-segment cut.

6. The acoustic panel of claim 5 wherein at the chosen vertical position, the bottom surface of the acoustic panel is unsupported, and the first and second panels are placeable in an engaged position wherein, when the first and second interlocking members are in their engaged positions, the elongated aperture has a diameter smaller than the diameter of the shaft.

7. The acoustic panel of claim 5, wherein the main body portion of the acoustic panel comprises a unitary body portion, both when the first and second interlocking members are in their engaged and disengaged positions.

8. The acoustic panel of claim 1 further comprising a first end panel detachably coupled to the first end of the main body portion.

9. The acoustic panel of claim 8, further comprising a second end panel detachably coupled to the second end of the main body portion.

10. The acoustic panel of claim 8 wherein the first end of the main body portion includes a first end interlocking member, and the first end panel includes a correspondingly configured first end panel interlocking member configured for matingly engaging the first end interlocking member.

11. The acoustic panel of claim 10 wherein the first end panel interlocking member matingly engages the first end interlocking member along substantially the entire length between the top and bottom surfaces of the main body portion.

12. The acoustic panel of claim 10, further comprising a second end panel detachably coupled to the second end of the main body portion.

13. The acoustic panel of claim 12 wherein the second end of the main body portion includes a second end interlocking member and the second end panel includes a correspondingly configured second end panel interlocking member configured for matingly engaging the second end interlocking member.

14. The acoustic panel of claim 13 wherein the first end panel interlocking member is configured generally similarly to the second end interlocking member, and the second end panel interlocking member is configured generally similarly to the first end interlocking member, whereby the acoustic panel comprises a first acoustic panel capable of being joined to a second acoustic panel by matingly engaging the first end interlocking member of one of the first and second acoustic panels with the second end interlocking member of the other of the first and second acoustic panel to place the first and second acoustic panels in an end-to-end interlocked relation.

15. The acoustic panel of claim 13 wherein the second end panel interlocking member matingly engages the second end interlocking member along substantially the entire length between the top and bottom surfaces of the main body portion.

16. A foam-type acoustic panel mountable to a stand having a shaft, the acoustic panel comprising:

a main body portion having:

(a) a first end, a second end, a front surface, a rear surface, a top surface and a bottom surface;

(b) a first interlocking member including a first portion extending in a first direction generally non-perpendicular to a plane defined by one of the front and rear surfaces, a second portion extending in a direction generally perpendicular to the first direction, and a third portion extending in a third direction defining an acute angle to the second direction, the third portion includes a bulbous male portion;

(c) a second interlocking member including a first portion for receiving the first portion of the first interlocking member, a second portion for receiving the second portion of the first interlocking member, and a third partly-cylindrical portion for receiving the bulbous male portion of the third portion of the first interlocking member, wherein, the first and second interlocking members define a multi-segment cut extending between the top and bottom surface, the multi-segment cut including a first end disposed at one of the front and rear surfaces, and a second end disposed interiorly of the other of the front and rear surfaces, the second end of the multi-segment cut defining an elongated aperture extending between the top and bottom surface for receiving a shaft of a stand, wherein the elongated aperture includes a longitudinally extending shaft receiving opening extending between the top and bottom surface and the first and second interlocking members being movable between a disengaged position for receiving a shaft of a stand into the elongated aperture by passing the shaft laterally through the shaft receiving opening of the multi-segment cut, and an engaged position wherein the shaft is engaged with sufficient frictional force to maintain the acoustic panel at a chosen vertical position on the shaft.

17. The acoustic panel of claim 16 wherein:

(a) at the chosen vertical position, the bottom surface of the acoustic panel is unsupported; and (b) when the first and second interlocking members are in their engaged position, the elongated aperture has a diameter smaller than the diameter of the shaft, and the main body portion of the acoustic panel comprises a unitary body portion, both when the first and second interlocking members are in their engaged and disengaged positions.

18. The acoustic panel of claim 16 wherein the first end of the main body portion includes a first end interlocking member, the second end of the main body portion includes a second end interlocking member, whereby the acoustic panel comprises a first acoustic panel capable of being joined to a second acoustic panel by matingly engaging the first end interlocking member of one of the first and second acoustic panels with the second end interlocking member of the other of the first and second acoustic panel to place the first and second acoustic panels in an end-to-end interlocked relation.

19. The acoustic panel of claim 17 wherein the first end of the main body portion includes a first end interlocking member, the second end of the main body portion includes a second end interlocking member, whereby the acoustic panel comprises a first acoustic panel capable of being joined to a second acoustic panel by matingly engaging the first end interlocking member of one of the first and second acoustic panels with the second end interlocking member of the other of the first and second acoustic panel to place the first and second acoustic panels in an end-to-end interlocked relation.

20. A foam-type acoustic panel mountable to a stand having a shaft, the acoustic panel comprising:

a main body portion having:

(a) a first end, a second end, a front surface, a rear surface, a top surface and a bottom surface, the first end, second end, front surface, rear surface, top surface and bottom surface all comprised of a sound absorbing foam material;

(b) a first interlocking member and a second interlocking member, the first and second interlocking members defining a multi-segment cut extending between the top and bottom surface, the multi-segment cut including a first end disposed at one of the front and rear surfaces, and a second end disposed interiorly of the other of the front and rear surfaces, the second end of the multi-segment cut defining an elongated aperture extending between the top and bottom surface for receiving a shaft of a stand;

(c) a first end interlocking member disposed at the first end of the main body portion; and (d) a second end interlocking member disposed at the second end of the main body portion, whereby the acoustic panel comprises a first acoustic panel capable of being joined to a second acoustic panel by matingly engaging the first end interlocking member of one of the first and second acoustic panels with the second end interlocking member of the other of the first and second acoustic panel to place the first and second acoustic panels in an end-to-end interlocked relation.

21. A foam-type acoustic panel and stand assembly comprising:

A. a stand having an elongated shaft,

B. a foam type acoustic panel capable of receiving the shaft for being mounted on the stand, the foam-type acoustic panel comprising:

(a) a first end, second end, a front surface, a rear surface, a top surface and a bottom surface (b) a first interlocking member and a second interlocking member, the first and second interlocking members defining a multi-segment cut extending between the top and bottom surface, the multi-segment cut including a first end disposed at one of the front and rear surfaces, and a second end disposed interiorly of the other of the front and rear surfaces, the second end of the multi-segment cut defining an elongated aperture extending between the top and bottom surface for receiving the elongated shaft of shaft stand.

* * * * *

UNITED STATES PATENT AND TRADEMARK OFFICE

CERTIFICATE OF CORRECTION

PATENT NO. : 6,584,736 B2 
DATED : July 1, 2003
INVENTOR(S) : Jeffrey E. Szymanski et al.

It is certified that error appears in the above-identified patent and that said Letters Patent is hereby corrected as shown below:

Title page,
Item [75], Inventor, please change "Jeffrey E. Szymanski" to -- Jeffrey D. Szymanski --

Signed and Sealed this

Eighth Day of February, 2005

JON W. DUDAS
*Director of the United States Patent and Trademark Office*